US012358707B2

(12) United States Patent
Hills

(10) Patent No.: US 12,358,707 B2
(45) Date of Patent: Jul. 15, 2025

(54) INTERLOCKING CONTAINER INSERT

(71) Applicant: Tradehost Inc., Pomona, CA (US)

(72) Inventor: Ryan Hills, Yorba Linda, CA (US)

(73) Assignee: Tradehost Inc., Pamona (CA)

( * ) Notice: Subject to any disclaimer, the term of this patent is extended or adjusted under 35 U.S.C. 154(b) by 168 days.

(21) Appl. No.: 18/499,881

(22) Filed: Nov. 1, 2023

(65) Prior Publication Data

US 2025/0136345 A1 May 1, 2025

(51) Int. Cl.
*B65D 81/113* (2006.01)
*B65B 55/20* (2006.01)

(52) U.S. Cl.
CPC ..... *B65D 81/113* (2013.01); *B65B 55/20* (2013.01); *B65D 2581/053* (2013.01)

(58) Field of Classification Search
CPC ..... B65D 81/113; A47G 27/0293; A47G 27/0212; A47G 27/0237; A63B 2225/09
See application file for complete search history.

(56) References Cited

U.S. PATENT DOCUMENTS 3,334,798 A 8/1967 Pezely, Jr. et al.
4,561,097 A * 12/1985 Siegel ..... A63F 9/10 434/96
4,603,445 A * 8/1986 Spann ..... A47C 27/146 5/736
4,621,022 A 11/1986 Kohaut et al.
5,052,158 A 10/1991 D'Luzansky
8,356,788 B2 * 1/2013 Drew ..... A47B 95/043 428/122
8,490,976 B2 * 7/2013 Salgado ..... A63F 3/00 273/153 R
10,343,802 B1 * 7/2019 Wu ..... B65B 59/001
10,968,573 B2 * 4/2021 Szönyi ..... E04F 15/02183
(Continued)

FOREIGN PATENT DOCUMENTS

CH 666460 7/1988
CN 104859955 5/2017
(Continued)

OTHER PUBLICATIONS

The International Searching Authority, International Search Report, Jul. 26, 2024, 3 pages, Republic of Korea.
(Continued)

*Primary Examiner* — Mollie Impink
(74) *Attorney, Agent, or Firm* — Kevin Schraven; Anooj Patel; Hankin Patent Law, APC

(57) ABSTRACT

An interlocking container insert device, method, and system comprising a plurality of interlocking container insert pieces that comprise a plurality of interlocking tabs, a plurality of interlocking cavities, and a body structure. The interlocking tabs may protrude distally from the body structure. The interlocking tabs of all of the pieces may have a tab size and a tab shape that are substantially the same. The interlocking cavities of all of the pieces may have a cavity size and a cavity shape that are substantially the same. The tab shape may be a mirror negative of the cavity shape. The interlocking tabs may interlock with the interlocking cavities. The interlocking container insert pieces may interlock to each other and form an interlocking container insert with a tessellate pattern.

19 Claims, 14 Drawing Sheets

(56) References Cited

U.S. PATENT DOCUMENTS

| | | | | |
|---|---|---|---|---|
| 2002/0179486 | A1 | 12/2002 | Hurwitz | |
| 2012/0097067 | A1 | 4/2012 | Fascio | |
| 2013/0178130 | A1* | 7/2013 | Balint | A63H 33/065 29/897.3 |
| 2014/0124472 | A1 | 5/2014 | Radvanyi | |
| 2018/0099781 | A1 | 4/2018 | McConnell | |

FOREIGN PATENT DOCUMENTS

| | | | | |
|---|---|---|---|---|
| DE | 2907253 | | 9/1980 | |
| DE | 10300547 | | 4/2004 | |
| KR | 10-1996-0007388 | | 3/1996 | |
| WO | WO2007/015681 | | 2/2007 | |
| WO | WO-2012035365 | A1 * | 3/2012 | E01C 5/00 |

OTHER PUBLICATIONS

The International Searching Authority, Written Opinion of the International Searching Authority, Jul. 26, 2024, 8 pages, Republic of Korea.

EPO—European Patent Search Report—Mar. 11, 2025.

* cited by examiner

INTERLOCKING CONTAINER INSERT

FIELD OF USE

The present disclosure relates, in general, to padded container inserts. More specifically, the present disclosure relates to a padded insert for a container that is made up of interlocking individual pieces, such that the insert is adjustable and conforms around the contents of the container.

BACKGROUND

Generally, padded container inserts are used to protect the contents of containers and packaging. They are typically made of high-density polyurethane foam and can be used with various items, from antiques to electronic equipment. Foam inserts have also been used to insulate items from extreme temperatures.

Container inserts can be custom-designed and constructed for each container and item to be contained within the container. Some container inserts are generically designed to allow for user customization at a lower cost. Traditional foam inserts consist mainly of a solid piece of non-reusable foam that is cut to fit a specific object and only that specific object. Other custom inserts typically utilize a pluck-and-pull system where the container insert is perforated, and a user plucks and pulls individual smaller units of the insert from the whole insert. Once a unit is plucked and pulled, it serves no other purpose and is typically discarded. In addition, once individual units have been removed from the insert, the insert can typically not be utilized for a different item to be contained.

Thus, what is needed is a container insert that is changeable and has individual units that interlock to form different shapes.

SUMMARY

To minimize the limitations in the prior art and to minimize other limitations that will become apparent upon reading and understanding the present specification, the present disclosure discloses a new and useful interlocking insert for containers.

The following presents a simplified overview of the example embodiments in order to provide a basic understanding of some embodiments of the example embodiments. This overview is not an extensive overview of the example embodiments. It is intended to neither identify key or critical elements of the example embodiments nor delineate the scope of the appended claims. Its sole purpose is to present some concepts of the example embodiments in a simplified form as a prelude to the more detailed description that is presented herein below. It is to be understood that both the following general description and the following detailed description are exemplary and explanatory only and are not restrictive.

One embodiment of the present disclosure is a container insert that comprises a border and a plurality of individual interlocking container insert pieces. The pieces may preferably be identical to each other and may form a tessellated pattern within the border may be removed and replaced in a reusable manner. The container insert may be configured to fit within a container, such as a case or travel case. The pieces may preferably be made from plastic or durable foam in order to protect objects within cavities formed when one or more pieces are removed.

The devices of the present disclosure may more efficiently fill the available space of a container without the need for a custom (but static and unchangeable) container insert. The container insert may be designed to fit different containers of varying sizes and shapes. The individual interlocking container insert pieces allow the device of the present disclosure to be used and reused, eliminating the need for one time use or single use inserts.

The present disclosure discloses a unique, better, and more efficient system and apparatus for filling container space to securely hold delicate devices. As disclosed in the present disclosure, an interlocking container insert may provide a universal container filling system.

An interlocking container insert device comprising: a plurality of interlocking container insert pieces; wherein each of the interlocking container insert pieces comprises: a plurality of interlocking tabs; a plurality of interlocking cavities; and a body structure. The plurality of interlocking tabs may be configured to protrude distally from the body structure; wherein all of the interlocking tabs have a tab size and a tab shape that may be substantially the same; wherein all of the interlocking cavities have a cavity size and a cavity shape that may be substantially the same; wherein each of the interlocking cavities may be formed by two adjacent interlocking tabs of the interlocking tabs and the body structure between the two adjacent interlocking tabs; wherein the tab shape may be a mirror negative of the cavity shape; wherein the interlocking tabs may be configured to interlock with the interlocking cavities of the interlocking container insert pieces; and wherein the plurality of interlocking container insert pieces may be configured to interlock to each other and form an interlocking container insert with a tessellate pattern. The interlocking container insert may further comprise: a border; wherein the border comprises a plurality of border interlocking tabs and a plurality of border interlocking cavities; wherein the border interlocking tabs may be configured to interlock with the interlocking cavities of the interlocking container insert pieces; wherein the border interlocking cavities may be configured to interlock with the interlocking tabs of the interlocking container insert pieces. The border may have an outer edge that may be configured to matingly engage with an interior surface of a container. The interlocking container insert with the tessellate pattern may have an outer edge that may be configured to engage with an interior surface of a container. The interlocking container insert with the tessellate pattern may comprise one or more object cavities that may be formed by removing one or more of the interlocking container insert pieces from the interlocking container insert with the tessellate pattern. The object cavities may be configured to be adjustable in size and shape by removing or adding one or more of the interlocking container insert pieces. The object cavities may be configured to be temporarily shaped to fit one or more specific objects. The interlocking container insert pieces and the border may be made of foam. The interlocking container insert pieces may be configured to be removably held in an interlocked state via friction. The interlocking container insert pieces and the border may be made of paper fiber materials. The body structure of one or more of the interlocking container insert pieces may be hollow.

Another embodiment may comprise: a plurality of interlocking container insert pieces; and a border; wherein each of the plurality of interlocking container insert pieces comprises: a plurality of interlocking tabs; a plurality of interlocking cavities; and a body structure. The interlocking tabs may be configured to protrude distally from the body structure. The interlocking tabs may have a tab size and a tab shape that may be substantially the same. The interlocking cavities have a cavity size and a cavity shape that may be substantially the same; wherein each of the interlocking cavities may be formed by two adjacent interlocking tabs of the interlocking tabs and the body structure between the two adjacent interlocking tabs. The tab shape may be a mirror negative of the cavity shape; wherein the interlocking tabs may be configured to interlock with the interlocking cavities of the interlocking container insert pieces; wherein the interlocking container insert pieces may be configured to interlock to each other and form an interlocking container insert with a tessellate pattern. The border may comprise a plurality of border interlocking tabs and a plurality of border interlocking cavities; wherein the border interlocking tabs may be configured to interlock with the interlocking cavities of the interlocking container insert pieces; wherein the border interlocking cavities may be configured to interlock with the interlocking tabs of the interlocking container insert pieces. The border may have an outer edge that may be configured to matingly engage with an interior surface of a container; and wherein the interlocking container insert with the tessellate pattern may comprise one or more object cavities that may be formed by removing one or more of the interlocking container insert pieces from the interlocking container insert with the tessellate pattern. The one or more object cavities may be configured to be adjustable in size and shape by removing or adding the one or more of the interlocking container insert pieces. The one or more object cavities may be configured to be temporarily shaped to fit one or more specific objects. The interlocking container insert pieces and the border may be made of foam. The interlocking container insert pieces may be configured to be removably held in an interlocked state via friction. The interlocking container insert pieces and the border may be made of paper fiber materials. The body structure of the interlocking container insert pieces may be hollow.

Another embodiment may comprise: a plurality of interlocking container insert pieces; and a border. Wherein each of the interlocking container insert pieces comprises: a plurality of interlocking tabs; a plurality of interlocking cavities; and a body structure. Wherein the interlocking tabs may be configured to protrude distally from the body structure; wherein all of the interlocking tabs may have a tab size and a tab shape that may be substantially the same. Wherein the interlocking cavities may have a cavity size and a cavity shape that may be substantially the same; wherein each of the interlocking cavities may be formed by two adjacent interlocking tabs of the interlocking tabs and the body structure between the two adjacent interlocking tabs; wherein the tab shape may be a mirror negative of the cavity shape. The interlocking tabs may be configured to interlock with the interlocking cavities of the interlocking container insert pieces. The interlocking container insert pieces may be configured to interlock to each other and form an interlocking container insert with a tessellate pattern. The border may comprise a plurality of border interlocking tabs and a plurality of border interlocking cavities. The border interlocking tabs may be configured to interlock with the interlocking cavities of the interlocking container insert pieces. The border interlocking cavities may be configured to interlock with the interlocking tabs of the interlocking container insert pieces. The border may have an outer edge that may be configured to matingly engage with an interior surface of a container. The interlocking container insert with the tessellate pattern may comprise one or more object cavities that may be formed by removing one or more of the interlocking container insert pieces from the interlocking container insert with the tessellate pattern. The object cavities may be configured to be adjustable in size and shape by removing or adding one or more interlocking container insert pieces. The object cavities may be configured to be temporarily shaped to fit one or more specific objects. The plurality of interlocking container insert pieces and the border may be made of foam; and wherein the interlocking container insert pieces may be configured to be removably held in an interlocked state via friction. The body structure of one or more of the interlocking container insert pieces may be hollow.

These, as well as other components, steps, features, objects, benefits, and advantages, will now become clear from a review of the following detailed description of illustrative embodiments, the accompanying drawings, and the claims.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps which are illustrated. When the same numeral appears in different drawings, it refers to the same or like components or steps.

DETAILED DESCRIPTION OF THE ILLUSTRATIVE EMBODIMENTS

Figure 1:
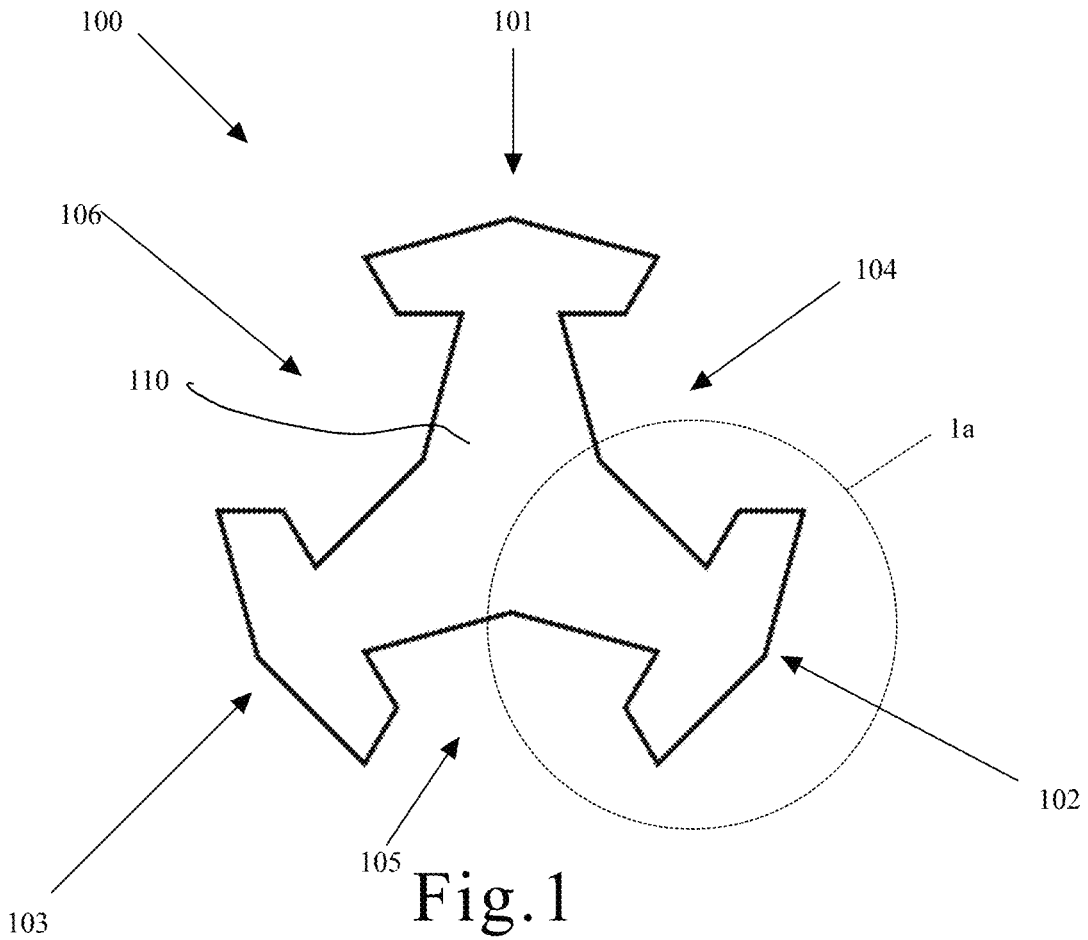
FIG. 1 is an illustration of a top view of one embodiment of an individual interlocking container insert piece.

In the following detailed description of various embodiments of the present disclosure, numerous specific details are set forth in order to provide a thorough understanding of various aspects of one or more embodiments of the present disclosure. However, one or more embodiments of the present disclosure may be practiced without some or all of these specific details. In other instances, well-known methods, procedures, and/or components have not been described in detail so as not to unnecessarily obscure aspects of embodiments of the present disclosure.

While multiple embodiments are disclosed, still other embodiments of the devices, systems, and methods of the present disclosure will become apparent to those skilled in the art from the following detailed description, which shows and describes illustrative embodiments of the devices, systems, and methods of the present disclosure. As will be realized, the devices, systems, and methods of the present disclosure are capable of modifications in various obvious aspects, all without departing from the spirit and scope of the present disclosure. Accordingly, the drawings, and the detailed descriptions thereof, are to be regarded as illustrative in nature and not restrictive. Also, the reference or non-reference to a particular embodiment of the devices, systems, and methods of the present disclosure shall not be interpreted to limit the scope of the present disclosure.

Before the present methods and systems are disclosed and described, it is to be understood that the methods and systems are not limited to specific methods, specific components, or to particular implementations. It is also to be understood that the terminology used herein is for the purpose of describing particular embodiments only and is not intended to be limiting.

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

Disclosed are components that may be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all embodiments of this application including, but not limited to, steps in disclosed methods. Thus, if there are a variety of additional steps that may be performed it is understood that each of these additional steps may be performed with any specific embodiment or combination of embodiments of the disclosed methods.

The present methods and systems may be understood more readily by reference to the following detailed description of preferred embodiments and the examples included therein and to the Figures and their previous and following description.

In the following description, certain terminology is used to describe certain features of one or more embodiments. For purposes of the specification, unless otherwise specified, the term "substantially" refers to the complete or nearly complete extent or degree of an action, characteristic, property, state, structure, item, or result. For example, in one embodiment, an object that is "substantially" located within a housing would mean that the object is either completely within a housing or nearly completely within a housing. The exact allowable degree of deviation from absolute completeness may in some cases depend on the specific context. However, generally speaking, the nearness of completion will be so as to have the same overall result as if absolute and total completion were obtained. The use of "substantially" is also equally applicable when used in a negative connotation to refer to the complete or near complete lack of an action, characteristic, property, state, structure, item, or result.

As used herein, the terms "approximately" and "about" generally refer to a deviance of within 5% of the indicated number or range of numbers. In one embodiment, the term "approximately" and "about", may refer to a deviance of between 0.001-10% from the indicated number or range of numbers.

Various embodiments are now described with reference to the drawings. In the following description, for purposes of explanation, numerous specific details are set forth in order to provide a thorough understanding of one or more embodiments. It may be evident, however, that the various embodiments may be practiced without these specific details. In other instances, well-known structures and devices are shown in block diagram form to facilitate describing these embodiments.

As used herein, the term "container insert" refers to specifically shaped units designed to fill a container. Generally, the container insert may be configured to snuggly fit within at least part of a container.

As used herein, the term "facet" refers to a flat surface in the shape of an insert and arranged in a geometrical pattern.

As used herein, the term "flexibility" refers to mechanical properties. Specifically, flexibility is a material's ability to bend without failing or breaking.

As used herein, the term "interlock" refers to joining or connecting closely or matingly. Typically, the connection is one portion of a piece fitting together with another portion of a second piece.

As used herein, the term "malleability" or "malleable" refer to mechanical properties of materials. Specifically, malleability is a material's ability to be reshaped, changed, adjusted, or physically pushed out of its normal shape, so as to fit without failing or braking.

As used herein, the term "deformability" or "deformable" refer to mechanical properties of materials. Specifically, deformability is a material's ability to be reshaped, changed, adjusted, or physically pushed out of its normal shape, so as to fit without failing or braking, wherein the material returns to its normal/typical shape, or approximately normal/typical shape, when outside physical forces are removed.

As used herein, the term "mirror image" refers to an object with an opposite handed spatial arrangement corresponding to another object.

As used herein, the term "mirror negative" or "mirror negatives" refers to two objects being designed to matingly fit together, wherein a first object has a specifically shaped protrusion, and a second object has that same specifically shape, but as a cavity.

As used herein, the term "tessellate" refers to a pattern using identical shapes that fit together with no spaces.

The main components of an interlocking container insert system are the individual interlocking container insert pieces and an optional interlocking container insert border. Individual interlocking container insert pieces may form a tessellated design using a plurality of identical interlocking container insert pieces.

The tessellating design allows for a plurality of interlocking container insert pieces to interlock and form an insert system, regardless of the orientation of an interlocking container insert.

Figure 1A:
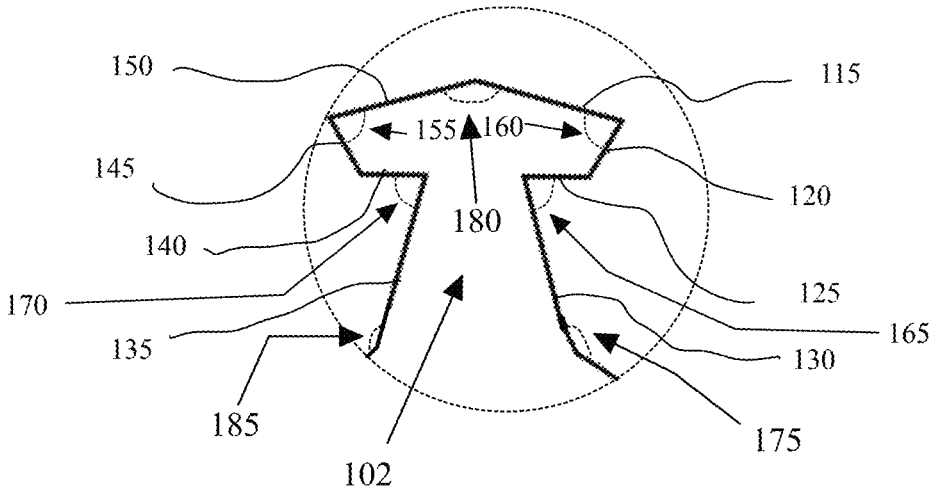
FIG. 1*a* is an illustration of a close-up and top view of one embodiment of an interlocking tab of an individual interlocking container insert piece.

FIG. 1 is an illustration of a top view of one embodiment of an individual interlocking container insert piece. FIG. 1*a* is an illustration of a close-up and top view of one embodiment of an interlocking tab of an individual interlocking container insert piece. Interlocking container insert piece 100 may comprise a plurality of facets and/or surfaces that interlock with a plurality of other interlocking container insert pieces. Interlocking container insert piece 100 may comprise first interlocking tab 101, second interlocking tab 102, third interlocking tab 103, first interlocking cavity 104, second interlocking cavity 105, third interlocking cavity 106, and body structure 110. Interlocking container insert piece 100 may be interlocked together with three other interlocking container insert pieces that are identical to piece 100, to form a tessellate design or pattern. A plurality of interlocking container insert pieces may be interlocked to form an adjustable container insert that may be used to fill all, or at least a portion of an internal volume of a container.

As shown in FIG. 1, first interlocking tab 101, second interlocking tab 102, and third interlocking tab 103 may preferably join to form body structure 110 in a unitary manner. Body structure 110 may alternatively be a separate structure and configured to permanently or durably attach first interlocking tab 101, second interlocking tab 102, and third interlocking tab 103. First interlocking tab 101, second interlocking tab 102, third interlocking tab 103, and body structure 110 may preferably be configured to form first interlocking cavity 104, second interlocking cavity 105, and third interlocking cavity 106. Although not shown, body structure 110 may also be configured to be hollow or have a large cavity. Besides being lighter, some benefits of constructing body structure 110 to be hollow or having a large cavity may allow interlocking container insert pieces 100 to be more flexible, malleable, crushable, deformable, or collapsible. The interlocking tabs 101, 102, 103, as shown, extend distally away from body structure 110.

First interlocking tab 101, second interlocking tab 102, and third interlocking tab 103 may preferably be identical to each other, which allows any piece to be removed and replaced with any other piece. First interlocking tab 101, second interlocking tab 102, and third interlocking tab 103 may also be mirror images when divided down the middle. Constructing first interlocking tab 101, second interlocking tab 102, and third interlocking tab 103 as mirror images and as a tessellate identical pieces, may allow interlocking container insert piece 100 to interlock with the other interlocking container insert pieces, regardless of orientation of the pieces and may allow for few if any limits on the arrangements that may be made to the container insert of the present disclosure. The container insert may be tailored to fit any container of any shape, simply by the removal or addition of the pieces.

First interlocking tab 101, second interlocking tab 102, and third interlocking tab 103 may preferably be positive protrusions that matingly fits with the mirror negatives of first interlocking cavity 104, second interlocking cavity 105, and/or third interlocking cavity 106.

Any of first interlocking tab 101, second interlocking tab 102, or third interlocking tab 103 may matingly interlock with any of first interlocking cavity 104, second interlocking cavity 105, or third interlocking cavity 106.

Although only one embodiment of interlocking container insert piece 100 is shown in FIG. 1, interlocking container insert piece 100 may be many different shapes and is not limited to be any specific shape, the number of facets, or a specific and tessellate design/pattern.

In one embodiment, interlocking container insert piece 100 may be made from any durable, flexible, malleable, and/or deformable material. Interlocking container insert piece 100 may be made from, but is not limited to, foam, memory foam, high-density polyurethane foam, synthetic rubber, polyethylene, polystyrene, or polyurethane, and paper fiber materials (which includes fiber materials made from wood, wood pulp, and grasses, such as bamboo), such as cardboard. Although flexible, malleable, and/or deformable materials may be preferred, interlocking container insert piece 100 may be made from rigid materials, including rigid materials that are crushable or collapsible so as to have force-dampening properties. Materials that the pieces may be made from include wood and grasses (such as bamboo or balsa wood), composites, plastics, foams, and metals.

FIG. 1*a* shows that second interlocking tab 102 may comprise first face facet 150, second face facet 115, face facet angle 180, first right side facet 120, second face to first right side angle 160, right lower facet 125, right lower to second right side angle 165, second right side facet 130, right cavity to face facet angle 175, left cavity to face facet angle 185, second left side facet 135, left lower to second left side angle 170, left lower facet 140, first left side facet 145, and first face to first left side angle 155.

First face facet 150 may form face facet angle 180 with second face facet 115. face facet angle 180 may be an angle between 0 and 180 degrees.

Second face facet 115 may form second face to first right side angle 160 with first right side facet 120. Second face to first right side angle 160 may preferably be an angle between 1 and 90 degrees. First right side facet 120 may be adjacent to and/or attached to right lower facet 125.

Right lower facet 125 may be configured to be adjacent to and/or attached to second right side facet 130 such that right lower to second right side angle 165 is formed between them.

First face facet 150 may form first face to first left side angle 155 with first left side facet 145. First face to first left side angle 155 may preferably be between 1 and 90 degrees. First left side facet 145 may be adjacent to and/or attached to left lower facet 140.

Left lower facet 140 may be configured to be adjacent to and/or attached to second left side facet 135, such that left lower to second left side angle 170 is formed between them.

First face to first left side angle 155 and second face to first right side angle 160, as shown, are preferably the same and are also preferably equal to left lower to second left side angle 170 and right lower to second right side angle 165, which are themselves the same. Preferably all four of the angles 155, 160, 165, and 170 are identical. Similarly, first right side facet 120, right lower facet 125, left lower facet 140, first left side facet 145, may preferably be equal (or substantially equal) in length. Additionally, second face facet 115, first face facet 150, second right side facet 130, and second left side facet 135 may preferably all be equal (or substantially equal) in length. When the angles and facets are the same, this allows the interlocking container insert pieces to matingly fit together in a substantially snug/tesselate manner.

Second right side facet 130 may be adjacent to and/or attached to second left side facet of third interlocking tab 103. Second right side facet 130 may form right cavity to face facet angle 175 with second left side facet of third interlocking tab 103. Right cavity to face facet angle 175 may preferably be the same or substantially the same as face facet angle 180.

Second left side facet 135 may be adjacent to and/or attached to second right side facet of first interlocking tab 101. Second left side facet 135 may form left cavity to face facet angle 185 with second right side facet (not shown) of first interlocking tab 101. Left cavity to face facet angle 185 may preferably be the same or substantially the same as face facet angle 180.

The structures of second interlocking tab 102 and third interlocking tab 103 may be substantially the same or even identical to the structures of first interlocking tab 101, as detailed in FIG. 1*a*.

Figure 2:
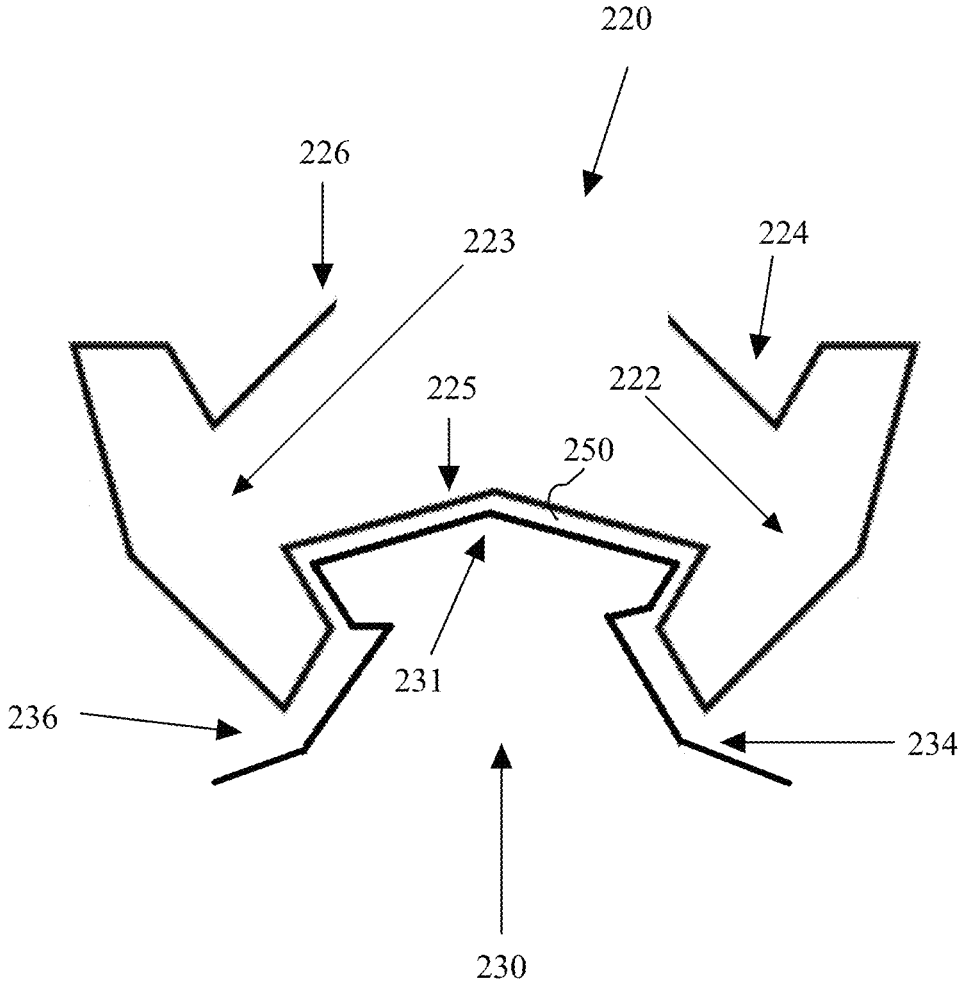
FIG. 2 is an illustration of a top view of one embodiment of an interlocking tab being engaged by another individual interlocking container insert piece.

FIG. 2 is an illustration of a top view of one embodiment of an interlocking tab being engaged by another individual interlocking container insert piece. As shown in FIG. 2, first interlocking container insert piece 220 and second interlocking container insert piece 230 may be configured to interlock together. Interlocking container insert piece 220 may comprise second interlocking tab 222, third interlocking tab 223, first interlocking cavity 224, second interlocking cavity 225, and third interlocking cavity 226. Interlocking container insert piece 230 may comprise first interlocking tab 231, first interlocking cavity 234 and third interlocking cavity 236. As shown, first interlocking tab 231 of second interlocking container insert piece 230 may preferably be a mirror negative of second interlocking cavity 225. Any difference in mirroring of first interlocking tab 231 of second interlocking container insert piece 230 may preferably be duplicated in the mirroring of interlocking cavity 225 and may be adapted to interlock using flexible, malleable, and/or deformable materials to construct first interlocking container insert piece 220 and second interlocking container insert piece 230. Although shown with a small gap 250 (for illustrative purposes), first interlocking container insert piece 220 and second interlocking container insert piece 230 may be configured to have no gaps and the facet surfaces may preferably be configured to be in direct contact with each.

Figure 3:
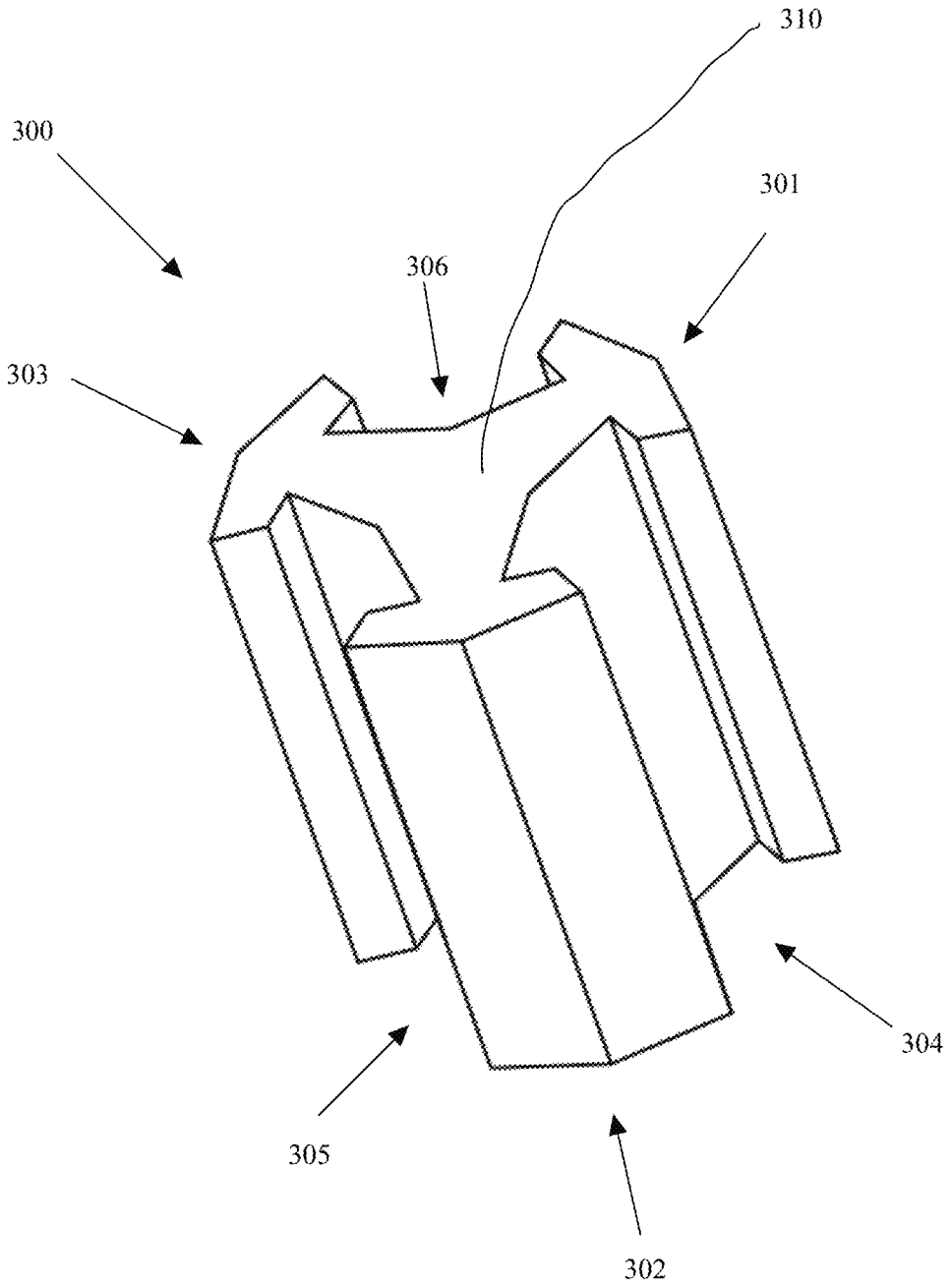
FIG. 3 is a top and side perspective view of one embodiment of an individual interlocking container insert piece.

FIG. 3 is a top and side perspective view of one embodiment of an individual interlocking container insert piece. Interlocking container insert piece 300 may comprise first interlocking tab 301, second interlocking tab 302, third interlocking tab 303, first interlocking cavity 304, second interlocking cavity 305, third interlocking cavity 306, and body structure 310. Interlocking container insert piece 300 may be of any size, length, or thickness, small, large, short, long, or anything in between. The use of large or small interlocking container insert pieces 300 may determine what objects may be stored in a container with the container insert. In order for interlocking container insert piece 300 to contain an item in a container securely, it may be preferable that the size of interlocking container insert piece 300 be limited to be approximately the smallest dimension of an object to be stored.

Figure 4:
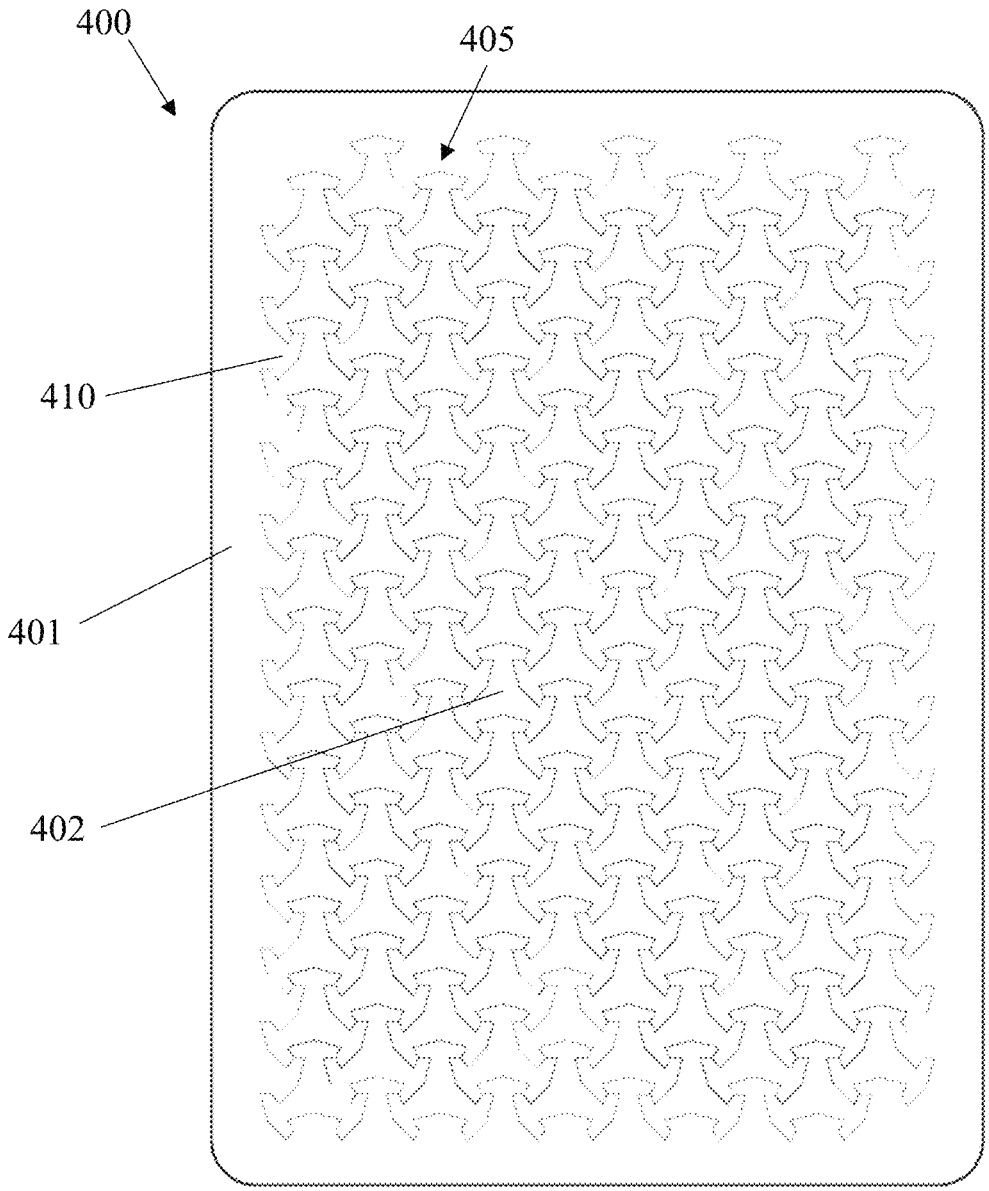
FIG. 4 is an illustration of a top view of one embodiment of a container insert with all of its individual interlocking container insert pieces.

FIG. 4 is an illustration of a top view of one embodiment of a container insert with all of its individual interlocking container insert pieces and showing a border. FIG. 4 shows that container insert 400 may comprise border 401 (which is an optional portion of the device of the present disclosure) and a plurality of interlocking container insert pieces 402. Border 401 may comprise a plurality of border interlocking tabs 410 and a plurality of border interlocking cavities 405, which are configured to engage with a plurality of interlocking tabs and interlocking cavities on the plurality of interlocking container insert pieces. In this manner, the container insert of the present disclosure is kept securely in place with a container. Specifically, the outer surface or edge of border 401 is configured to matingly engage with an interior surface of a container. Although border 401 allows for ease of providing a functional container insert, it is not needed and can be replaced by adding additional interlocking container insert pieces 402 to the outer portion of the container insert. Border 401 may provide structural support and stability to the plurality of interlocked interlocking container insert pieces 402.

Border 401 may be the outer portion of a multi-edged container insert and/or the outer portion of a curved/rounded container insert. Although shown as straight, border 401 may be curved or have defined sides.

Border 401 and may be durable, flexible, malleable, and/or deformable, and may be substantially any shape, which may allow the insert to fit within different types of containers and hold different types of objects. Interlocking container insert pieces 402 and border 401 may be made from, but not be limited to, foam, such as, high-density polyurethane foam, synthetic rubber, polyethylene, polystyrene, or polyurethane, and paper fiber materials. Although flexible, malleable, and/or deformable materials may be preferred for the construction of interlocking container insert pieces 402 and border 401, they may be made from any type of materials. The type of materials used may affect the container insert's ability to protect objects from damage.

Figure 5:
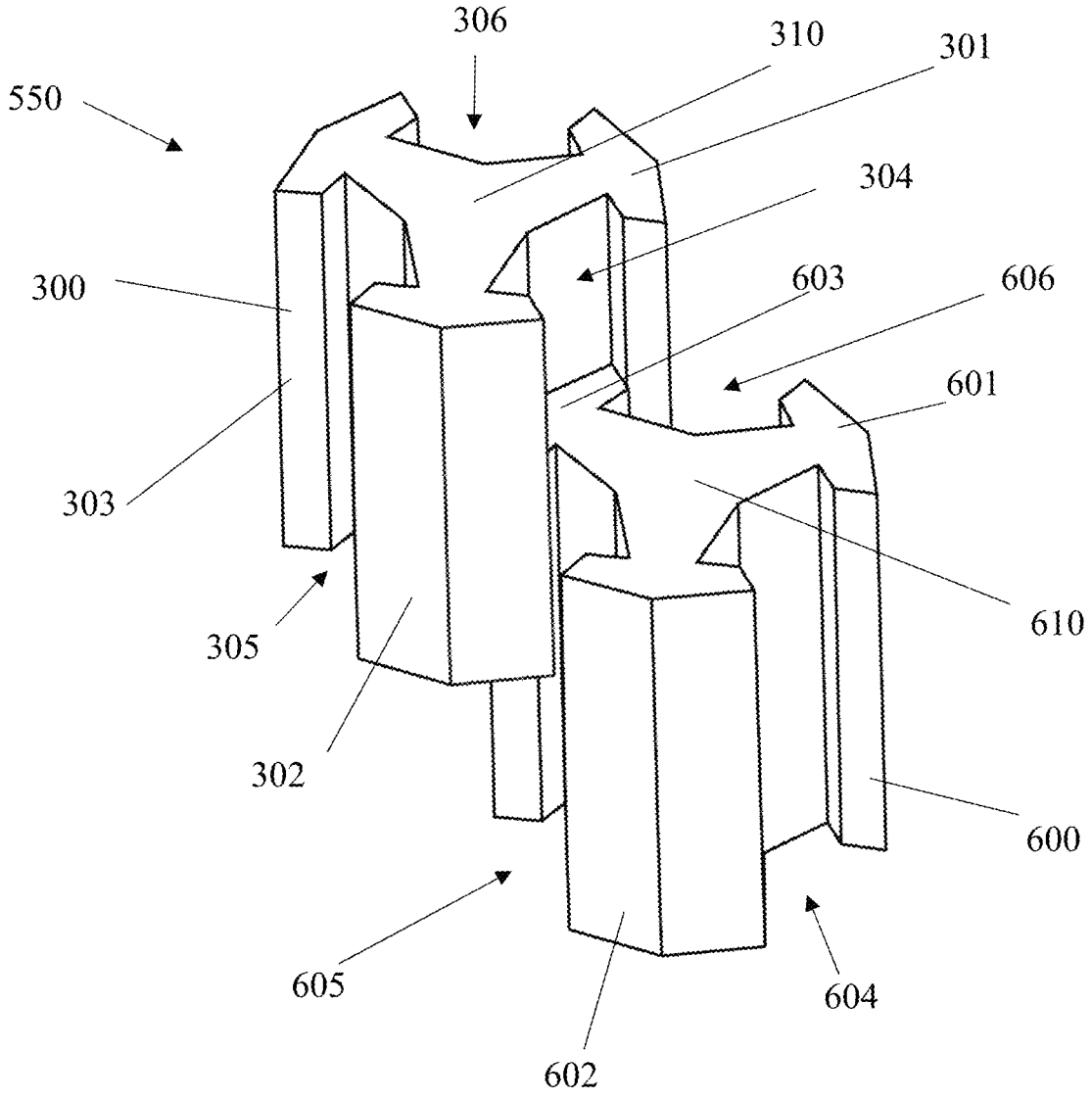
FIG. 5 is a top and side perspective view of one individual interlocking container insert piece being slidably connected to or disconnected from a second individual interlocking container insert piece.

FIG. 5 is a top and side perspective view of one individual interlocking container insert piece being slidably connected to or disconnected from a second individual interlocking container insert piece. Interlocking container insert piece 300 may comprise first interlocking tab 301, second interlocking tab 302, third interlocking tab 303, first interlocking cavity 304, second interlocking cavity 305, third interlocking cavity 306, and body structure 310. Interlocking container insert piece 600 may comprise first interlocking tab 601, second interlocking tab 602, third interlocking tab 603, first interlocking cavity 604, second interlocking cavity 605, third interlocking cavity 606, and body structure 610. As shown in FIG. 5, interlocking container insert piece 300 may matingly engage with interlocking container insert piece 600 and they are essentially identical to each other in shape and dimensions. Although the two pieces 300 and 600 may be deformable and may be smooshed together to interlock, they may also be slidably connected or disconnected from each other, as preferred. As shown, third interlocking tab 603 is a mirror negative of first interlocking cavity 304, such that they matingly fit together. When pieces 300 and 600 are made of foam, there is some friction when they are slid against each other, but this may be overcome by applying a slight or otherwise reasonable force. This same friction keeps the two pieces 300 and 600 from sliding on their own, such that they are kept in place against each other as desired by a user.

As shown in FIG. 5, each of the two pieces 300, 600 may have the same vertical length (sometimes referred to as height), such that when they are slid together to have an even top surface, the bottom surface is also even between the two pieces 300, 600. The vertical length of the pieces 300, 600 may be significantly shorter or significantly longer than shown, depending on the size of the container and what type of objects are being protected by the container insert of the present disclosure.

Figure 6:
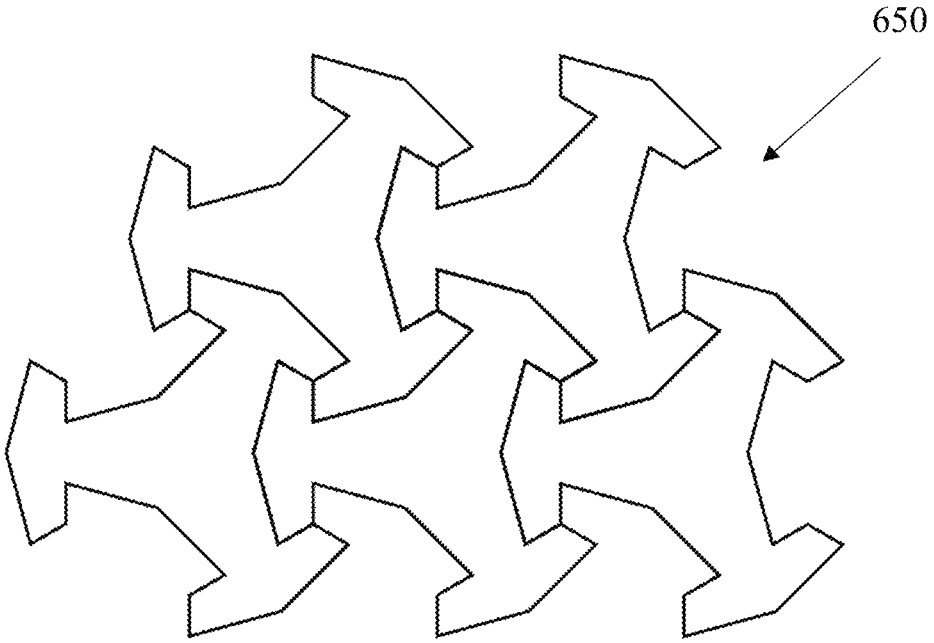
FIG. 6 is a top view of one embodiment of five individual interlocking container insert pieces that are matingly connected to each other.

FIG. 6 is a top view of one embodiment of five individual interlocking container insert pieces that are matingly connected to each other. FIG. 6 shows five interlocking container insert pieces interlocked with each other to form container insert 650.

Figure 7:
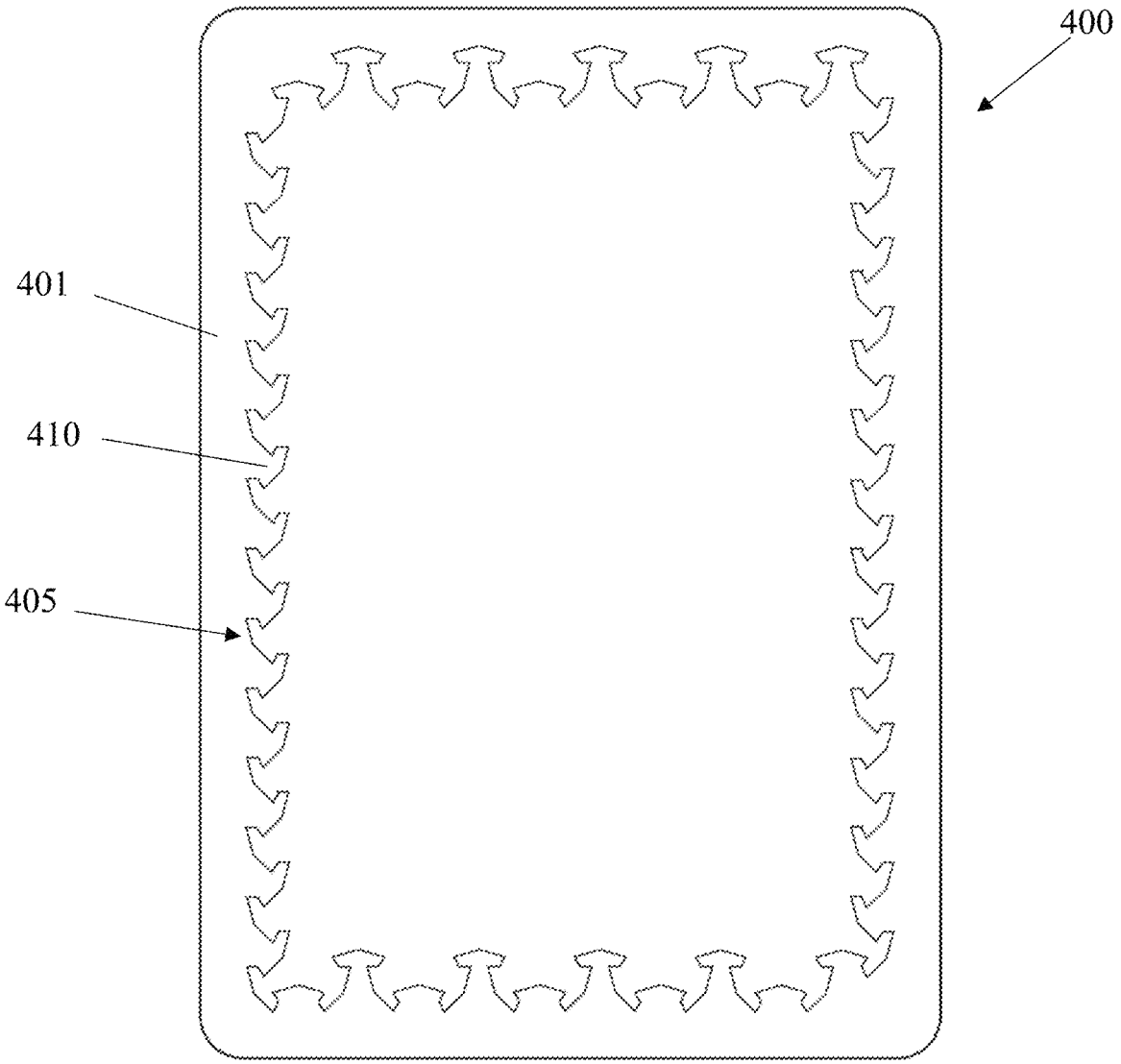
FIG. 7 is a top view of one embodiment of a container insert with all of its individual interlocking container insert pieces removed, showing the border of the container insert.

FIG. 7 is a top view of one embodiment of a container insert with all of its individual interlocking container insert pieces removed, showing the border of the container insert. FIG. 7 shows that container insert 400 may comprise border 401, which is configured to engage with and contain a plurality of interlocking container insert pieces. Border 401 may comprise a plurality of border interlocking tabs 410 and a plurality of border interlocking cavities 405, which are configured to engage with a plurality of interlocking tabs and interlocking cavities on the plurality of interlocking container insert pieces.

Figure 8:
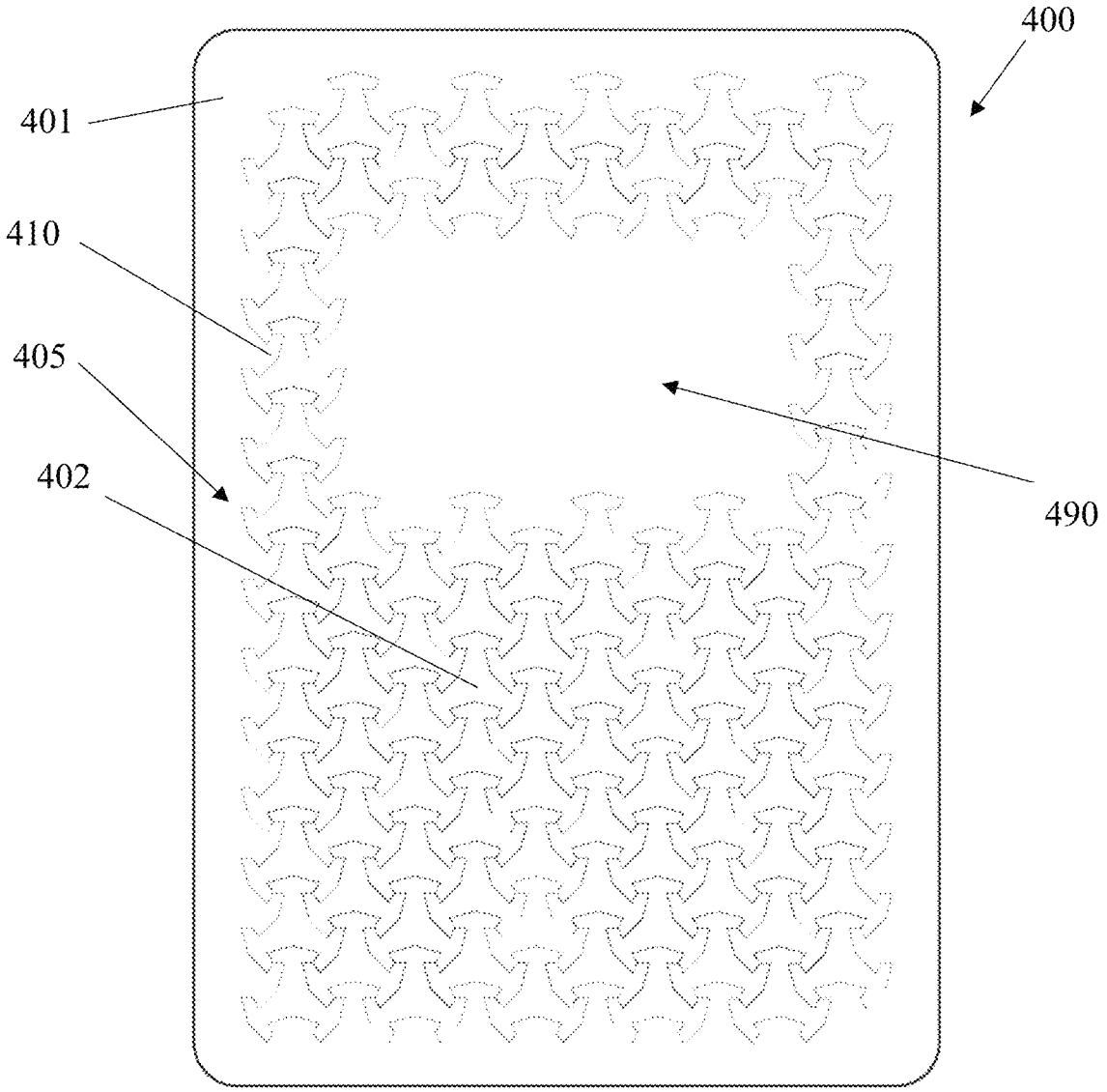
FIG. 8 is a top view of one embodiment of a container insert with some individual interlocking container insert pieces removed, such that a custom cavity is formed.

FIG. 8 is a top view of one embodiment of a container insert with some individual interlocking container insert pieces removed, such that a custom cavity is formed. FIG. 8 shows that container insert 400 may comprise border 401, which contains and/or engages with a plurality of interlocking container insert pieces 402. Border 401 may comprise a plurality of border interlocking tabs 410 and a plurality of border interlocking cavities 405, which are configured to engage with a plurality of interlocking tabs and interlocking cavities on the plurality of interlocking container insert pieces. FIG. 8 shows that some of the interlocking container insert pieces have been removed thus forming cavity 490. Cavity 490 may be made to fit a specific object to be protected within the container. Cavity 490 may be adjusted to be bigger or smaller by adding or removing one or more of the interlocking container insert pieces 402.

Figure 9:
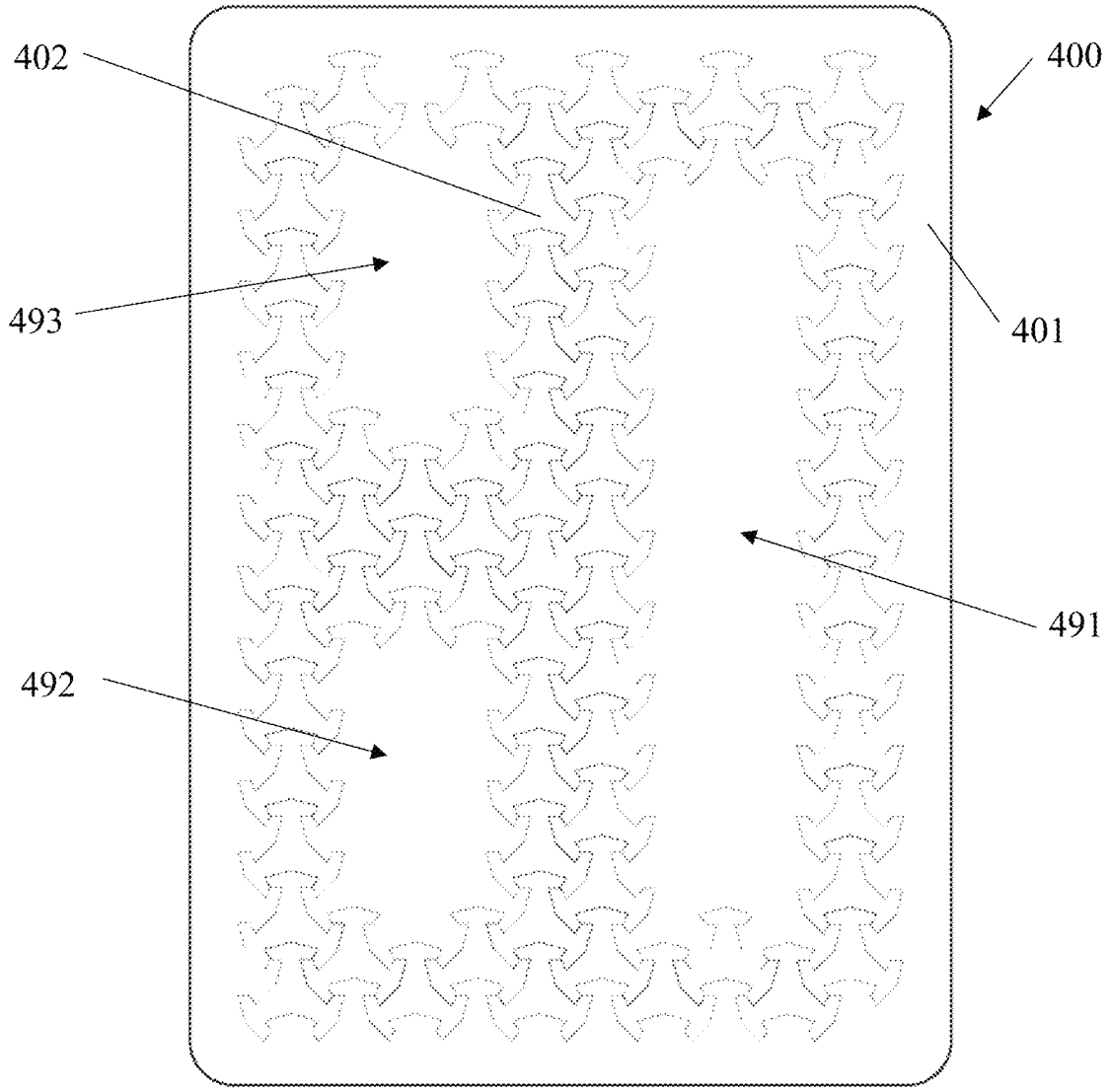
FIG. 9 is a top view of one embodiment of a container insert with some individual interlocking container insert pieces removed, such that three custom cavities are formed.

FIG. 9 is a top view of one embodiment of a container insert with some individual interlocking container insert pieces removed, such that three custom cavities are formed. FIG. 9 shows that container insert 400 may comprise border 401, which contains and/or engages with a plurality of interlocking container insert pieces 402. Border 401 may comprise a plurality of border interlocking tabs 410 and a plurality of border interlocking cavities 405, which are configured to engage with a plurality of interlocking tabs and interlocking cavities on the plurality of interlocking container insert pieces. FIG. 9 shows that some of the interlocking container insert pieces have been removed thus forming object cavities 491, 492, 493. Object cavities 491, 492, 493 may be made to fit specific objects to be protected within the container. Object cavities 491, 492, 493 may be adjusted to be made bigger or smaller by adding or removing one or more of the interlocking container insert pieces 402.

Figure 10:
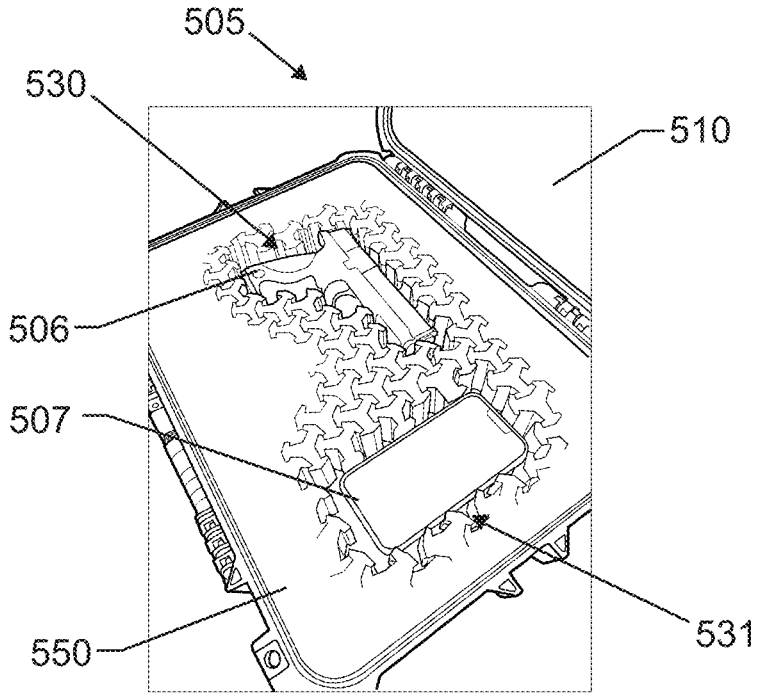
FIG. 10 top perspective view of container with one embodiment of a container insert with individual interlocking container insert pieces removed, such that two custom cavities are formed.

FIG. 10 top perspective view of container with one embodiment of a container insert with individual interlocking container insert pieces removed, such that two custom cavities are formed. FIG. 10 shows that interlocking container insert 550 has been inserted in the main body of container 505. As shown, container 505 is a hard shell hinged brief case style container that has lid 510. The container insert 550 has had several interlocking container insert pieces removed forming two object cavities 530, 531. FIG. 10 shows that object cavities 530, 531 matingly and protectively contain gun/pistol 506 and electronic device 507, respectively.

Figure 11:
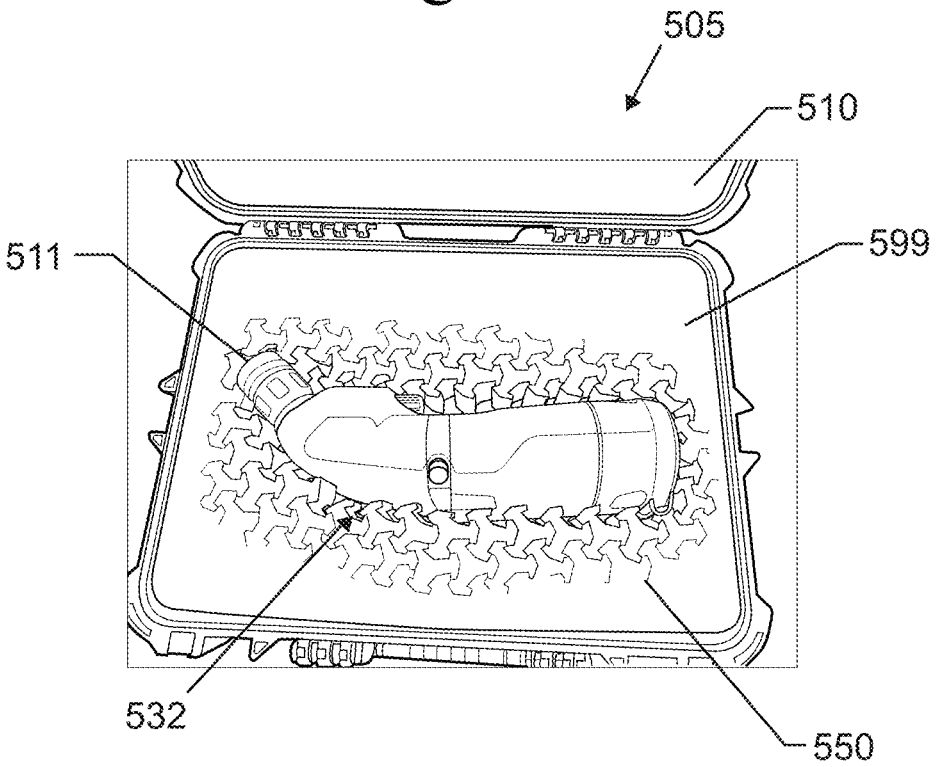
FIG. 11 is a top view of one embodiment of a container insert with some individual interlocking container insert pieces removed, such that a custom cavity is formed.

FIG. 11 is a top view of one embodiment of a container insert with some individual interlocking container insert pieces removed, such that a custom cavity is formed. FIG. 11 shows that interlocking container insert 550 has been inserted in the main body of container 505. As shown, container 505 is a hard shell hinged brief case style container that has lid 510. The container insert 550 has been altered from what is shown in FIG. 10 by adding and removing specific interlocking container insert pieces in order to form a unique shaped object cavity 532. FIG. 11 shows that object cavity 532 matingly and protectively contains optical device 511.

FIG. 11 also shows that the outer surface of insert 550 may matingly match, be a mirror negative of, and/or engage with an interior of the container 505. As shown, the outer edge of border 599 of insert 550 may conform to and engage with the interior of container 505.

Figure 12:
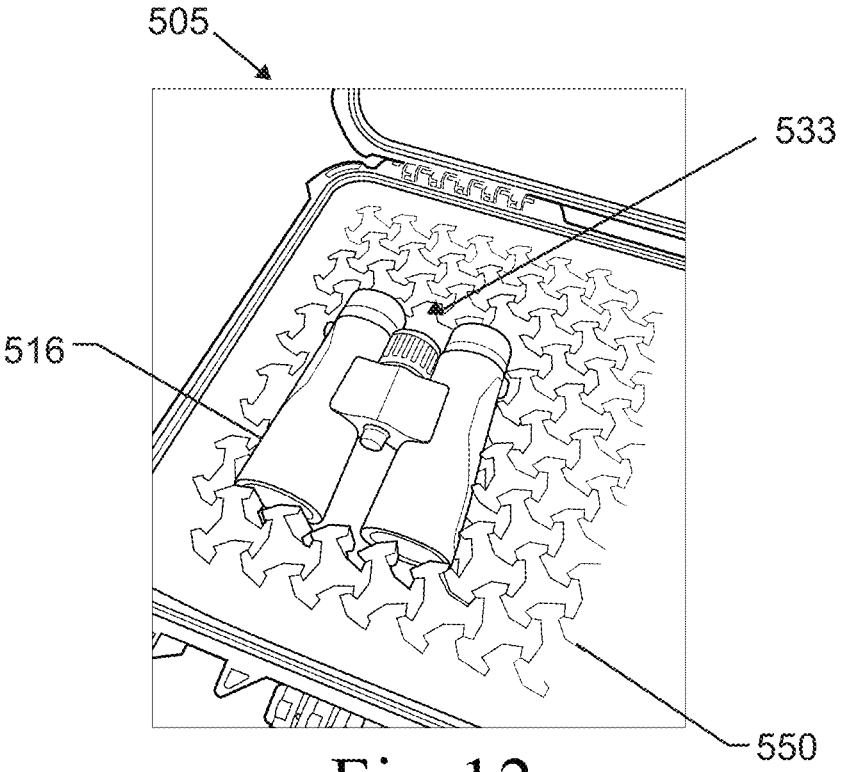
FIG. 12 is a top view of one embodiment of a container insert with some individual interlocking container insert pieces removed, such that a custom cavity is formed.

FIG. 12 is a top view of one embodiment of a container insert with some individual interlocking container insert pieces removed, such that a custom cavity is formed. FIG. 12 shows that interlocking container insert 550 has been inserted in the main body of container 505. As shown, container 505 is a hard shell hinged brief case style container. The container insert 550 has been altered from what is shown in FIGS. 10 and 11 by adding and removing specific interlocking container insert pieces in order to form object cavity 533. FIG. 12 shows that object cavity 533 matingly and protectively contains optical device 516.

Figure 13:
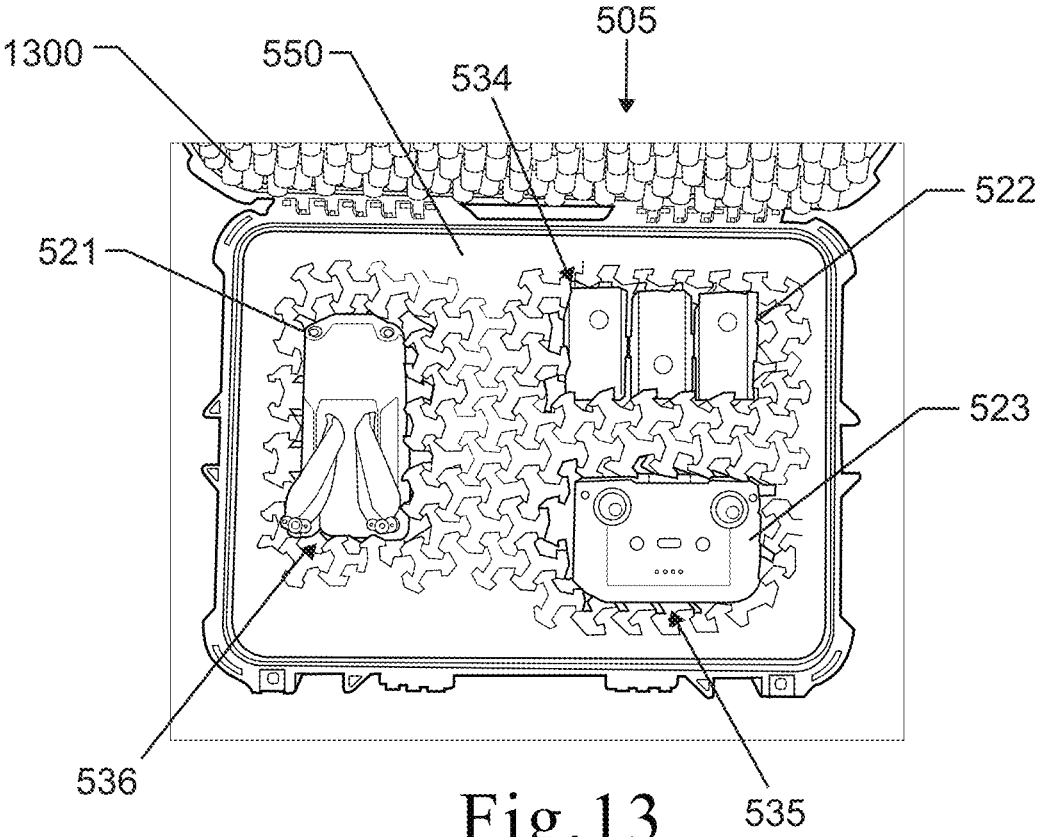
FIG. 13 is a top view of one embodiment of a container insert with some individual interlocking container insert pieces removed, such that three custom cavities are formed.

FIG. 13 is a top view of one embodiment of a container insert with some individual interlocking container insert pieces removed, such that three custom cavities are formed. FIG. 13 shows that interlocking container insert 550 has been inserted in the main body of container 505. As shown, container 505 is a hard shell hinged brief case style container that has lid that contains foam lid insert 1300. The container insert 550 has been altered from what is shown in FIGS. 10, 11, and 12 by adding and removing specific interlocking container insert pieces in order to form three new object cavities 534, 535, 536. FIG. 13 shows that object cavities 534, 535, 536 matingly and protectively contain or cradle drone 521, batteries 522, and remote controller 523, respectively. FIG. 13 shows that top foam insert 1300 may be placed in a lid of container 505, which provides further protection to the objects.

FIGS. 10-13 show that the object cavities formed by removing and adding (in an interlocked manner) may be temporary and/or adjustable in size and shape.

Figure 14:
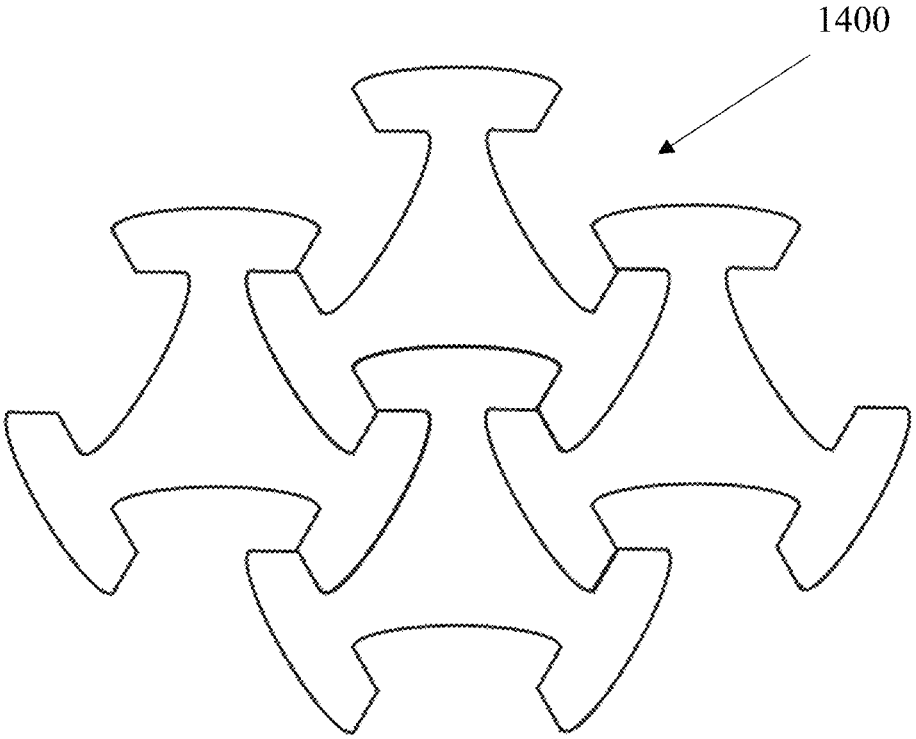
FIG. 14 is a top view of another embodiment of individual interlocking container insert pieces that are matingly connected to each other.

FIG. 14 is a top view of another embodiment of individual interlocking container insert pieces that are matingly connected to each other. FIG. 14 shows four interlocking container insert pieces with rounded tabs interlocked with each other to form container insert 1400.

Figure 15:
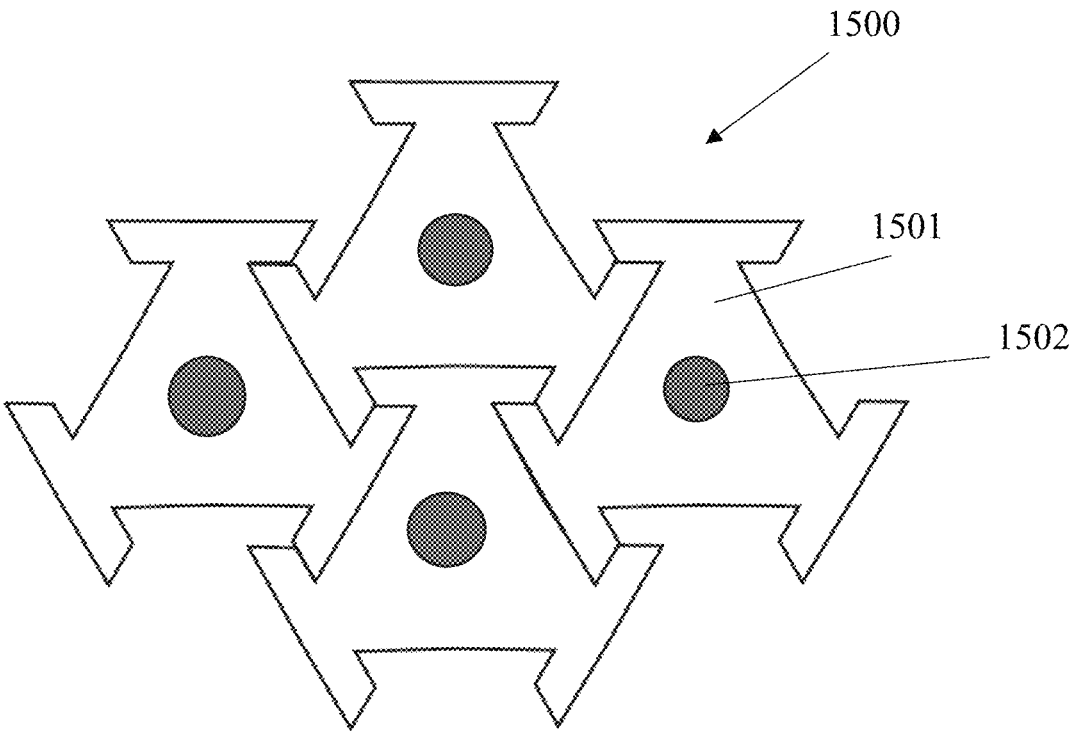
FIG. 15 is a top view of another embodiment of individual interlocking container insert pieces that are matingly connected to each other.

FIG. 15 is a top view of another embodiment of individual interlocking container insert pieces that are matingly connected to each other. FIG. 15 shows four interlocking container insert pieces with flat tabs interlocked with each other to form container insert 1500. FIG. 15 shows that the interlocking container insert pieces may have a body structure 1501 that has a hole or hollow portion 1502. This makes the pieces lighter and requires less material to manufacture.

Figure 16:
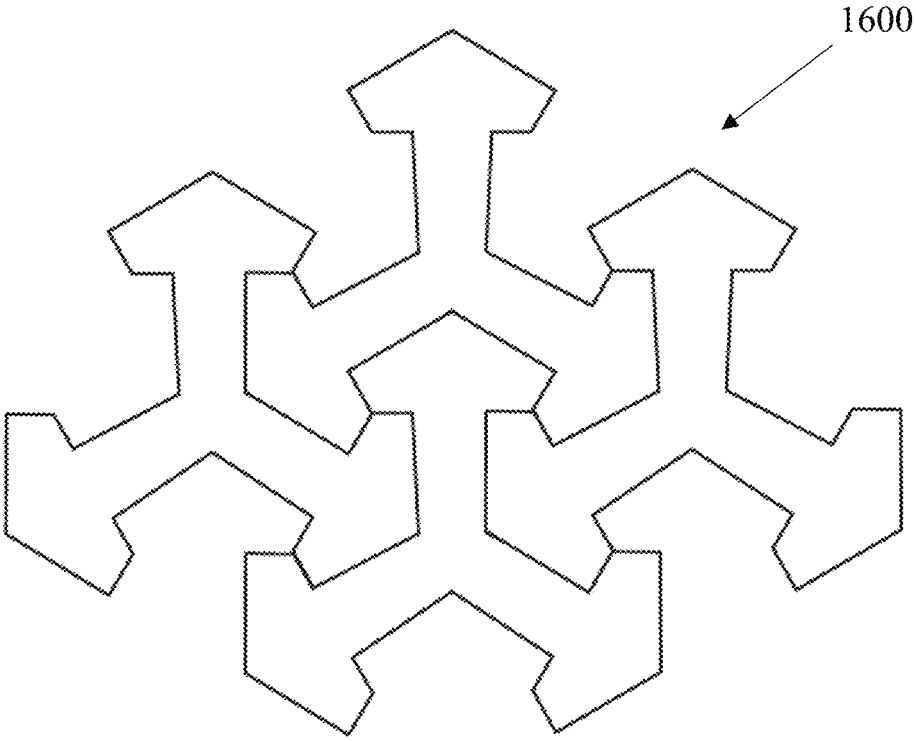
FIG. 16 is a top view of another embodiment of individual interlocking container insert pieces that are matingly connected to each other.

FIG. 16 is a top view of another embodiment of individual interlocking container insert pieces that are matingly connected to each other. FIG. 16 shows four interlocking container insert pieces with arrow tabs interlocked with each other to form container insert 1600.

Unless otherwise stated, all measurements, values, ratings, positions, magnitudes, sizes, locations, and other specifications that are set forth in this specification, including in the claims that follow, are approximate, not exact. They are intended to have a reasonable range that is consistent with the functions to which they relate and with what is customary in the art to which they pertain.

The foregoing description of the preferred embodiment has been presented for the purposes of illustration and description. While multiple embodiments are disclosed, still other embodiments will become apparent to those skilled in the art from the above detailed description. These embodiments are capable of modifications in various obvious aspects, all without departing from the spirit and scope of protection. Accordingly, the detailed description is to be regarded as illustrative in nature and not restrictive. Also, although not explicitly recited, one or more embodiments may be practiced in combination or conjunction with one another. Furthermore, the reference or non-reference to a particular embodiment shall not be interpreted to limit the scope of protection. It is intended that the scope of protection not be limited by this detailed description, but by the claims and the equivalents to the claims that are appended hereto.

Except as stated immediately above, nothing that has been stated or illustrated is intended or should be interpreted to cause a dedication of any component, step, feature, object, benefit, advantage, or equivalent, to the public, regardless of whether it is or is not recited in the claims.

What is claimed is:

1. An interlocking container insert device comprising:

a plurality of padded interlocking container insert pieces;

wherein each of said plurality of interlocking container insert pieces comprises: a plurality of interlocking tabs; a plurality of interlocking cavities; and a body structure;

wherein said plurality of interlocking tabs are configured to protrude distally from said body structure;

wherein all of said plurality of interlocking tabs have a tab size and a tab shape that are substantially the same;

wherein all of said plurality of interlocking cavities have a cavity size and a cavity shape that are substantially the same;

wherein each of said plurality of interlocking cavities are formed by two adjacent interlocking tabs of said plurality of interlocking tabs and said body structure between said two adjacent interlocking tabs;

wherein said tab shape is a mirror negative of said cavity shape;

wherein said plurality of interlocking tabs are configured to interlock with said plurality of interlocking cavities of said plurality of interlocking container insert pieces; and wherein said plurality of interlocking container insert pieces are configured to interlock to each other and form an interlocking container insert with a tessellate pattern wherein said interlocking container insert with said tessellate pattern may comprise one or more object cavities that are formed by removing one or more of said plurality of interlocking container insert pieces from said interlocking container insert with said tessellate pattern.

2. The device of claim 1, further comprising:

a border;

wherein said border comprises a plurality of border interlocking tabs and a plurality of border interlocking cavities;

wherein said plurality of border interlocking tabs are configured to interlock with said plurality of interlocking cavities of said plurality interlocking container insert pieces;

wherein said plurality of border interlocking cavities are configured to interlock with said plurality of interlocking tabs of said plurality of interlocking container insert pieces.

3. The device of claim 2, wherein said border has an outer edge that is configured to matingly engage with an interior surface of a container.

4. The device of claim 2, wherein said plurality of interlocking container insert pieces and said border are made of foam.

5. The device of claim 4, wherein said plurality of interlocking container insert pieces are configured to be removeably held in an interlocked state via friction.

6. The device of claim 2, wherein said plurality of interlocking container insert pieces and said border are made of paper fiber materials.

7. The device of claim 2, wherein said body structure of one or more of said plurality of interlocking container insert pieces are hollow.

8. The device of claim 1, wherein said interlocking container insert with said tessellate pattern has an outer edge that is configured to engage with an interior surface of a container.

9. The device of claim 1, wherein said one or more object cavities are configured to be adjustable in size and shape by removing or adding said one or more of said plurality of interlocking container insert pieces.

10. The device of claim 9, wherein said one or more object cavities are configured to be temporarily shaped to fit one or more specific objects.

11. An interlocking container insert device comprising:

a plurality of padded interlocking container insert pieces; and a border;

wherein each of said plurality of interlocking container insert pieces comprises: a plurality of interlocking tabs; a plurality of interlocking cavities; and a body structure;

wherein said plurality of interlocking tabs are configured to protrude distally from said body structure;

wherein all of said plurality of interlocking tabs have a tab size and a tab shape that are substantially the same;

wherein all of said plurality of interlocking cavities have a cavity size and a cavity shape that are substantially the same;

wherein each of said plurality of interlocking cavities are formed by two adjacent interlocking tabs of said plurality of interlocking tabs and said body structure between said two adjacent interlocking tabs;

wherein said tab shape is a mirror negative of said cavity shape;

wherein said plurality of interlocking tabs are configured to interlock with said plurality of interlocking cavities of said plurality of interlocking container insert pieces;

wherein said plurality of interlocking container insert pieces are configured to interlock to each other and form an interlocking container insert with a tessellate pattern;

wherein said border comprises a plurality of border interlocking tabs and a plurality of border interlocking cavities;

wherein said plurality of border interlocking tabs are configured to interlock with said plurality of interlocking cavities of said plurality interlocking container insert pieces;

wherein said plurality of border interlocking cavities are configured to interlock with said plurality of interlocking tabs of said plurality of interlocking container insert pieces;

wherein said border has an outer edge that is configured to matingly engage with an interior surface of a container; and wherein said interlocking container insert with said tessellate pattern may comprise one or more object cavities that are formed by removing one or more of said plurality of interlocking container insert pieces from said interlocking container insert with said tessellate pattern.

12. The device of claim 11, wherein said one or more object cavities are configured to be adjustable in size and shape by removing or adding said one or more of said plurality of interlocking container insert pieces.

13. The device of claim 11, wherein said one or more object cavities are configured to be temporarily shaped to fit one or more specific objects.

14. The device of claim 11, wherein said plurality of interlocking container insert pieces and said border are made of foam.

15. The device of claim 14, wherein said plurality of interlocking container insert pieces are configured to be removeably held in an interlocked state via friction.

16. The device of claim 11, wherein said plurality of interlocking container insert pieces and said border are made of paper fiber materials.

17. The device of claim 11, wherein said body structure of one or more of said plurality of interlocking container insert pieces are hollow.

18. An interlocking container insert device comprising:

a plurality of padded interlocking container insert pieces; and a border;

wherein each of said plurality of interlocking container insert pieces comprises: a plurality of interlocking tabs; a plurality of interlocking cavities; and a body structure;

wherein said plurality of interlocking tabs are configured to protrude distally from said body structure;

wherein all of said plurality of interlocking tabs have a tab size and a tab shape that are substantially the same;

wherein all of said plurality of interlocking cavities have a cavity size and a cavity shape that are substantially the same;

wherein each of said plurality of interlocking cavities are formed by two adjacent interlocking tabs of said plurality of interlocking tabs and said body structure between said two adjacent interlocking tabs;

wherein said tab shape is a mirror negative of said cavity shape;

wherein said plurality of interlocking tabs are configured to interlock with said plurality of interlocking cavities of said plurality of interlocking container insert pieces;

wherein said plurality of interlocking container insert pieces are configured to interlock to each other and form an interlocking container insert with a tessellate pattern;

wherein said border comprises a plurality of border interlocking tabs and a plurality of border interlocking cavities;

wherein said plurality of border interlocking tabs are configured to interlock with said plurality of interlocking cavities of said plurality interlocking container insert pieces;

wherein said plurality of border interlocking cavities are configured to interlock with said plurality of interlocking tabs of said plurality of interlocking container insert pieces;

wherein said border has an outer edge that is configured to matingly engage with an interior surface of a container;

wherein said interlocking container insert with said tessellate pattern may comprise one or more object cavities that are formed by removing one or more of said plurality of interlocking container insert pieces from said interlocking container insert with said tessellate pattern;

wherein said one or more object cavities are configured to be adjustable in size and shape by removing or adding said one or more of said plurality of interlocking container insert pieces;

wherein said one or more object cavities are configured to be temporarily shaped to fit one or more specific objects;

wherein said plurality of interlocking container insert pieces and said border are made of foam; and wherein said plurality of interlocking container insert pieces are configured to be removeably held in an interlocked state via friction.

19. The device of claim 18, wherein said body structure of one or more of said plurality of interlocking container insert pieces are hollow.

* * * * *